US007144311B2

(12) United States Patent
Jaensch

(10) Patent No.: US 7,144,311 B2
(45) Date of Patent: Dec. 5, 2006

(54) FOOT UNIT FOR ABRASIVE CUTTING-OFF MACHINE

(75) Inventor: Wolfgang Jaensch, Tremsbuttel (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 11/127,494

(22) Filed: May 12, 2005

(65) Prior Publication Data

US 2005/0252502 A1 Nov. 17, 2005

(30) Foreign Application Priority Data

May 13, 2004 (DE) ..... 20 2004 007 699 U

(51) Int. Cl.
*B24B 23/00* (2006.01)
*B28D 1/04* (2006.01)

(52) U.S. Cl. ..... 451/358; 451/352; 125/13.01; 125/13.03

(58) Field of Classification Search ..... 451/350, 451/352, 358; 125/13.01, 13.03, 14
See application file for complete search history.

(56) References Cited

U.S. PATENT DOCUMENTS

| | | | | |
|---|---|---|---|---|
| 2,069,700 A | | 2/1937 | Emmons | 51/170 |
| 3,092,156 A | | 6/1963 | Hayden | |
| 3,656,468 A | | 4/1972 | Weldon | 125/13 |
| 3,896,783 A | | 7/1975 | Manning | 125/13 |
| 4,188,935 A | | 2/1980 | Tubesing | 125/13 |
| 4,204,714 A | | 5/1980 | Jacobson et al. | 299/1 |
| 5,241,946 A | * | 9/1993 | Yelton et al. | 125/14 |
| 5,381,780 A | * | 1/1995 | Yelton et al. | 299/39.3 |
| 5,452,943 A | | 9/1995 | Campbell | 299/39 |
| 5,540,210 A | | 7/1996 | Jones | 125/13.01 |
| 5,676,115 A | | 10/1997 | Linsbauer et al. | 123/516 |
| 5,803,071 A | * | 9/1998 | Chiuminatta et al. | 125/13.01 |
| 6,050,253 A | * | 4/2000 | Nilsson et al. | 125/13.01 |
| 6,102,022 A | * | 8/2000 | Schave | 125/13.01 |

(Continued)

FOREIGN PATENT DOCUMENTS

DE G 87 09 158.5 7/1987

(Continued)

OTHER PUBLICATIONS

U.S. Appl. No. 11/037,667, filed Jan. 18, 2005, entitled "Device for Pushing a Carriage for an Abrasive Cutting-Off Machine", 11 pages plus 3 figures. Not Yet Published.

(Continued)

*Primary Examiner*—Eileen P. Morgan
(74) *Attorney, Agent, or Firm*—Nash and Titus, LLC

(57) ABSTRACT

The invention described here entails a work device (such as an abrasive cutting-off machine) that can be comfortably guided in a work position and is stable in a turned-off position without components relative to safety being exposed to increased wear. In particular, the work device has a foot unit having at least one rolling means and at least one support. The foot unit makes it possible to guide the abrasive cutting-off machine on the at least one rolling means in the work position and to set it on the support in the turned-off position.

10 Claims, 3 Drawing Sheets

U.S. PATENT DOCUMENTS

| | | | | |
|---|---|---|---|---|
| 6,374,501 | B1 * | 4/2002 | Claesson | 30/389 |
| 6,595,840 | B1 | 7/2003 | Jaensch et al. | |
| 6,742,265 | B1 | 6/2004 | Radel | |
| 6,814,192 | B1 | 11/2004 | Ziegs | |
| 2003/0131839 | A1 * | 7/2003 | Steiner et al. | 125/13.01 |
| 2004/0172834 | A1 | 9/2004 | Ziegs | |
| 2004/0183274 | A1 | 9/2004 | Schipper | |
| 2005/0055832 | A1 | 3/2005 | Jaensch | |
| 2005/0066928 | A1 | 3/2005 | Vick | |
| 2005/0172946 | A1 * | 8/2005 | Markley | 125/13.01 |

FOREIGN PATENT DOCUMENTS

| | | | |
|---|---|---|---|
| DE | 44 27 738 | A1 | 2/1996 |
| DE | 198 39 341 | A1 | 3/2000 |
| DE | 203 04 278 | U1 | 3/2003 |
| GB | 725735 | | 3/1955 |
| GB | 1050337 | A | 12/1966 |
| JP | 63256353 | | 10/1988 |
| SE | 414326 | | 12/1979 |

OTHER PUBLICATIONS

Swedish Examination Report in corresponding Swedish patent application 0501023-6, dated Nov. 2, 2005, 4 pages.

English translation of text of Swedish Examination Report in corresponding Swedish patent application 0501023-6, dated Nov. 2, 2005, 2 pages.

* cited by examiner

FOOT UNIT FOR ABRASIVE CUTTING-OFF MACHINE

FIELD OF THE INVENTION

This application claims priority from German utility model application DE 20 2004 007 699.3, filed May 13, 2004.

The invention relates to a work device, in particular an abrasive cutting-off machine, with at least one support on which the abrasive cutting-off machine can be set in a turned-off position on a floor space and that can be shifted from the turned-off position into a work position by being tilted about the at least one support, and with at least one rolling means arranged between the support and a cutting disk, which means contacts the floor space in the work position.

BACKGROUND OF THE INVENTION

Work devices in the form of abrasive cutting-off machines are sufficiently known. Abrasive cutting-off machines can be used in various ways by a user. In manual operation the abrasive cutting-off machine can be grasped on two handles by the user and must be carried and guided on the two handles by the user in order to make short cut lines. In particular, in order to make long cut lines or expansion joints in floor coverings, the manual operation requires a great amount of force and is therefore unsuitable. In addition, the abrasive cutting-off machine can be mounted on a guide carriage. The guide carriage relieves the user from having to carry the abrasive cutting-off machine. The user need merely guide and push the guide carriage with the abrasive cutting-off machine. Abrasive cutting-off machines and guide carriages are known, e.g., from DE 198 39 341 A1. Guide carriages are large devices whose acquisition entails additional expense.

Furthermore, U.S. Pat. No. 4,188,935 teaches an abrasive cutting-off machine in which a roller is provided on which the abrasive cutting-off machine rests. The roller connects open ends of a bracket handle and is arranged between the motor and the cutting disk. The abrasive cutting-off machine can be guided via the roller in a work position. In a turned-off position the abrasive cutting-off machine rests on the roller. The cutting edge does not contact the floor space in the turned-off position. It can therefore rotate freely in the turned-off position until it runs down. However, an abrasive cutting-off machine is not particularly stable in this design and moves on the floor space via the non-fixed roller on account of its idling vibrations.

In another known design a bracket handle of the abrasive cutting-off machine functions as support in the turned-off position. The rollers contact the floor space only in the work position. The bracket handle is exposed to increased wear due to friction, caused by vibrations, with the floor space. However, bracket handles are components of the abrasive cutting-off machine that are subject to particularly strict safety conditions.

SUMMARY OF THE INVENTION

The present invention addresses the above-mentioned issues by making a work device available that can be comfortably guided in a work position and is stable in a turned-off position without components relative to safety being exposed to increased wear. In particular, the work device (such as an abrasive cutting-off machine) has a foot unit having at least one rolling means and at least one support. The foot unit makes it possible to guide the abrasive cutting-off machine on the at least one rolling means in the work position and to set it on the support in the turned-off position. The work device is not resting on components that have safety concerns, and as a result of this they are protected from wear.

DETAILED DESCRIPTION OF THE PREFERRED EMBODIMENTS

Figure 1:
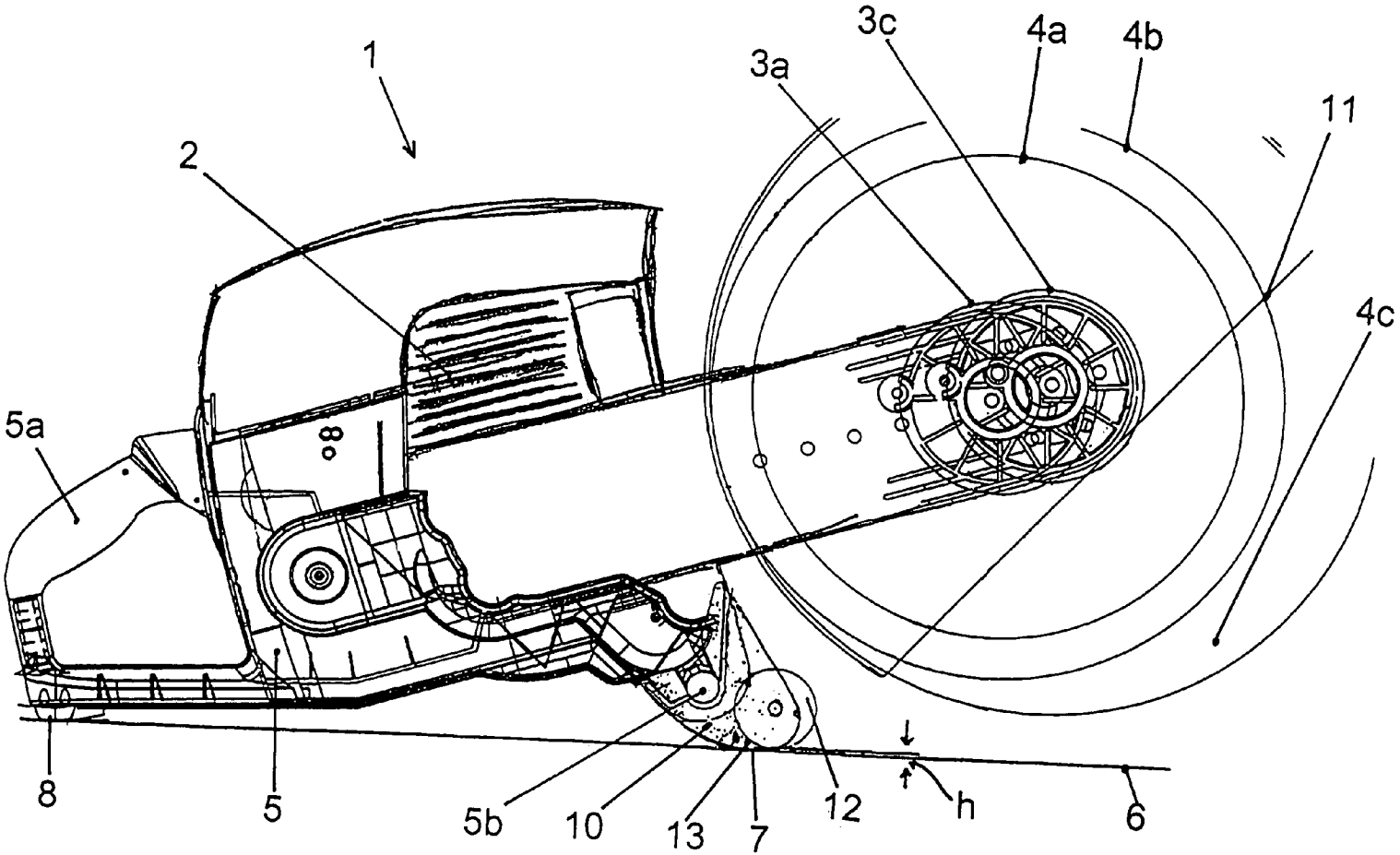
FIG. 1 shows a lateral view of an abrasive cutting-off machine with a foot unit in accordance with the invention.

The invention entails a work device such as the type mentioned above, in particular an abrasive cutting-off machine, with a foot unit on which the at least one rolling means and the at least one support are arranged. As noted above, the foot unit makes it possible to guide the abrasive cutting-off machine on the at least one rolling means in the work position and to set it on the support in the turned-off position. In particular, the abrasive cutting-off machine is not set on components relevant to safety and as a result of this they are protected from wear.

The at least one support cooperates with the at least one rolling means since the abrasive cutting-off machine can be tilted between the turned-off position and the work position and in the first position the support and in the second position the rolling means makes contact with the floor space. In order that the functional interrelation can be taken into account better, the foot unit comprises the at least one support and the at least one rolling means. Thus, the relative arrangement of the at least one support and of the at least one rolling means required for the functional interrelation can be exactly reversed.

Moreover, the integration of the at least one support and of the at least one rolling means in a single component makes possible their complete and convenient removal. In particular, the rolling means is a spatial hindrance for fixing the abrasive cutting-off machine on a guide carriage for the initially cited carriage operation. The work device of the invention is also suited for carriage operation after a brief redesigning.

The foot unit can have a wear zone preferably designed as wear material whose end facing away from the abrasive cutting-off machine forms the at least one support and that can be reduced by wear without loss of function. The wear caused by putting down the abrasive cutting-off machine and the idling vibrations acts primarily on this wear zone that protects components relevant to safety.

In a preferred embodiment of the invention the foot unit can be detached from the work device and replaced by another foot unit, especially a higher foot unit. In this preferred embodiment the support is part of a replaceable foot unit. On one hand this makes it possible for a worn support to be economically replaced and on the other hand during the mounting of larger cutting disks on the abrasive cutting-off machine a higher foot unit can be selected in order that even a larger cutting disk can rotate freely in the turned-off position. Higher foot units have a greater interval between the grip unit and the at least one support. The foot unit can be screwed, e.g., to the grip unit or it can be fastened in a rapidly detachable manner by a snap closure or a quick-acting closure.

The bracket grip of known abrasive cutting-off machines is fastened by a grip holder that can be a light-metal component on a side of the grip unit facing the floor space. The traditional grip holder can be provided with holders, e.g., bores for the foot unit by slight modifications.

In an embodiment of the invention that can be manufactured in a particularly advantageous manner the foot unit comprises at least one arm for seating a wheel shaft of the at least one rolling means and the wheel shaft has an interval from the support that corresponds to a radius of the rolling means plus a height. It is achieved in a simple manner in this foot unit that the rolling means has no contact with the floor space in the turned-off position and is arranged in a freely rotatable manner over the floor space by an interval corresponding to the height.

The wear zone is advantageously lower than the above-cited height. The wear zone can be arranged on an end of the at least one arm which end faces the floor space. The height of the wear zone corresponds to the distance that can be rubbed off by wear from the at least one arm without the rolling means contacting the floor space in the turned-off position. The foot unit can be designed as a magnesium component, as an aluminum component or preferably as a die-cast part.

A stable guidance of the abrasive cutting-off machine is made possible in the work position in another embodiment in which the foot unit comprises two spaced arm pairs, each of which receives a wheel shaft of a rolling means. This makes it possible for the abrasive cutting-off machine to be guided on two rollers in the work position and lateral tilting movements are therefore not possible.

The foot unit preferably runs on the wall facing the floor space on the end of the gripping unit facing the cutting disk along a width of the gripping unit and has a free space between the two arm pairs for the removal of cut material. The cut material separated out in the work position, in particular concrete dust and glowing steel chips can be removed from the cutting area through the free space between the two rolling means and thus does not hinder the cutting process.

One area of the foot unit can form a protection for the removal of cut material. The protection for the removal of cut material protects a section of the bracket grip along the width of the gripping unit that meets rather strict protection regulations as a safety component. This protection for the removal of cut material is arranged between the two arm pairs and can protect the bracket grip in particular from additional thermal stresses by flying sparks or chips. The protection for the removal of cut material can have an armoring consisting, e.g., of metal, in particularly of aluminum.

The invention is described in three figures using an exemplary embodiment.

Abrasive cutting-off machine 1 shown in FIG. 1 comprises motor unit 2 connected via connecting arm 3*a* 3*c* to cutting disk 4*a*, 4*b*, 4*c*. FIG. 1 shows small cutting disk 4*a* with a small radius and average cutting disk 4*b* with an average radius. Both small cutting disk 4*a* and average cutting disk 4*b* can be mounted alternatively on a short connection arm 3*a*. In addition, FIG. 1 shows large cutting disk 4*c* that must be mounted on a long connection arm 3*c*.

Motor unit 2 comprises a two-stroke internal combustion engine and is partially surrounded by gripping unit 5 in which it is elastically mounted. FIG. 1 shows abrasive cutting-off machine 1 in a turned-off position in which abrasive cutting-off machine 1 stands in a stable manner on floor space 6 and in which cutting disk 4*a*, 4*b*, 4*c* can rotate freely over floor space 6. Abrasive cutting-off machine 1 stands on front supports 7 and rear support 8 that are firmly connected to gripping unit 5. Rear support 8 is formed in one piece on a wall of pistol grip 5*a* facing floor space 6, which grip is arranged on a wall of gripping unit 2 located opposite cutting disk 4*a*, 4*b*, 4*c*. Gripping unit 2 comprises foot unit 10 on the wall facing floor space 6 on an end facing cutting disk 4*a*, 4*b*, 4*c*. Front supports 7 are formed by areas of foot unit 10 facing away from gripping unit 5. In the turned-off position shown in FIG. 1 abrasive cutting-off machine 1 also rests on front supports 7 of foot unit 10. A center of gravity of abrasive cutting-off machine 1 is arranged over floor space 6 between rear 8 and front supports 7. Thus, abrasive cutting-off machine 1 stands in a stable manner on floor space 6 in the turned-off position. Because cutting disk 4*a*, 4*b*, 4*c* does not touch floor space 6, it is therefore possible to place abrasive cutting-off machine 1 on floor space 6 in the turned-off position even during operation, that is, when cutting disk 4*a*, 4*b*, 4*c* is rotating. Abrasive cutting-off machine 1 stands securely in the turned-off position even during operation.

Foot unit 10 is detachably connected to gripping unit 5. When cutting disks that are even larger than large cutting disk 4*c* and a connection arm that is even longer than long connection arm 3*c* are used, foot unit 10 shown in FIG. 1 can be replaced by a higher foot unit that raises the area of gripping unit 5 facing cutting disk 4*a*, 4*b*, 4*c* higher over floor space 6 than foot unit 10 shown.

FIG. 1 shows protection hood 11 whose size is adapted to large cutting disk 4*c* and to long connection arm 3*c*.

Abrasive cutting-off machine 1 is guided in a work position by the user on pistol grip 5*a* and on bracket grip 5*b* (only partially shown). Bracket grip 5*b* comprises a bent tube whose one section (shown) is guided on the wall facing floor space 6 along the end facing cutting disk 4*a*, 4*b*, 4*c*. The section of bracket grip 5*b* runs along a width of gripping unit 5 vertically to the plane of cutting disk 4*a*, 4*b*, 4*c*. Foot unit 10 covers the section of bracket grip 5*b* to cutting disk 4*a*, 4*b*, 4*c* and thus protects bracket grip 5*b* from flying chips and sparks.

Foot unit 10 comprises two wheels 12 adjacent to front supports 7 and each rotatably connected by wheel shaft 14 to foot unit 10. Wheels 12 do not contact floor space 6 in the turned-off position. Wheels 12 are rotatably arranged at height h above floor space 6. The internal combustion engine operated in the turned-off position and rotating cutting disk 4*a*, 4*b*, 4*c* produce vibrations and small shifts of abrasive cutting-off machine 1 on floor space 6. The section of foot unit 10 corresponding to height h in FIG. 1 above front supports 7 is a wear zone 13. Abrasive cutting-off machine 1 is stable in the turned-off position as long as wear zone 13 is not worn. If wear zone 13 is worn and the wheels 12 therefore make contact with floor space 6 in the turned-off position, the abrasive cutting-off machine 1 begins to travel. Abrasive cutting-off machine 1 "dances". Foot unit 10 should then be replaced.

Front supports 7 are bent toward gripping unit 5. As a result thereof, abrasive cutting-off machine 1 can be tilted about bent front supports 7 from the turned-off position into a work position. For this, abrasive cutting-off machine 1 is raised on pistol grip 5*a* by the user. In the work position wheels 12 make contact with floor space 6 and front supports 7 make no contact with floor space 6. As soon as wheels 12 make contact with floor space 6, abrasive cutting-off machine 1 can be guided on pistol grip 5*a* and bracket grip 5*b* by the user. Cutting disk 4*a*, 4*b*, 4*c* does not yet make contact with floor space 6 in the described position. When the abrasive cutting-off machine is tilted further about both wheels 12, clockwise in FIG. 1, cutting disk 4*a*, 4*b*, 4*c* makes contact sooner or later with floor space 6 depending on the size of the cutting disk. In the work position cuts can be made in floor space 6. The user does not have to carry the weight of abrasive cutting-off machine 1 but rather merely needs to guide abrasive cutting-off machine 1.

Foot unit 10 is detachably screwed to a holder on gripping unit 5. If wear zone 13 is worn, foot unit 10 can be replaced. If a cutting disk is used that is even larger than large cutting disk 4*c*, foot unit 10 should be replaced by a higher foot unit so that the even larger cutting disk also does not make contact with floor space 6 in the turned-off position.

Figure 2:
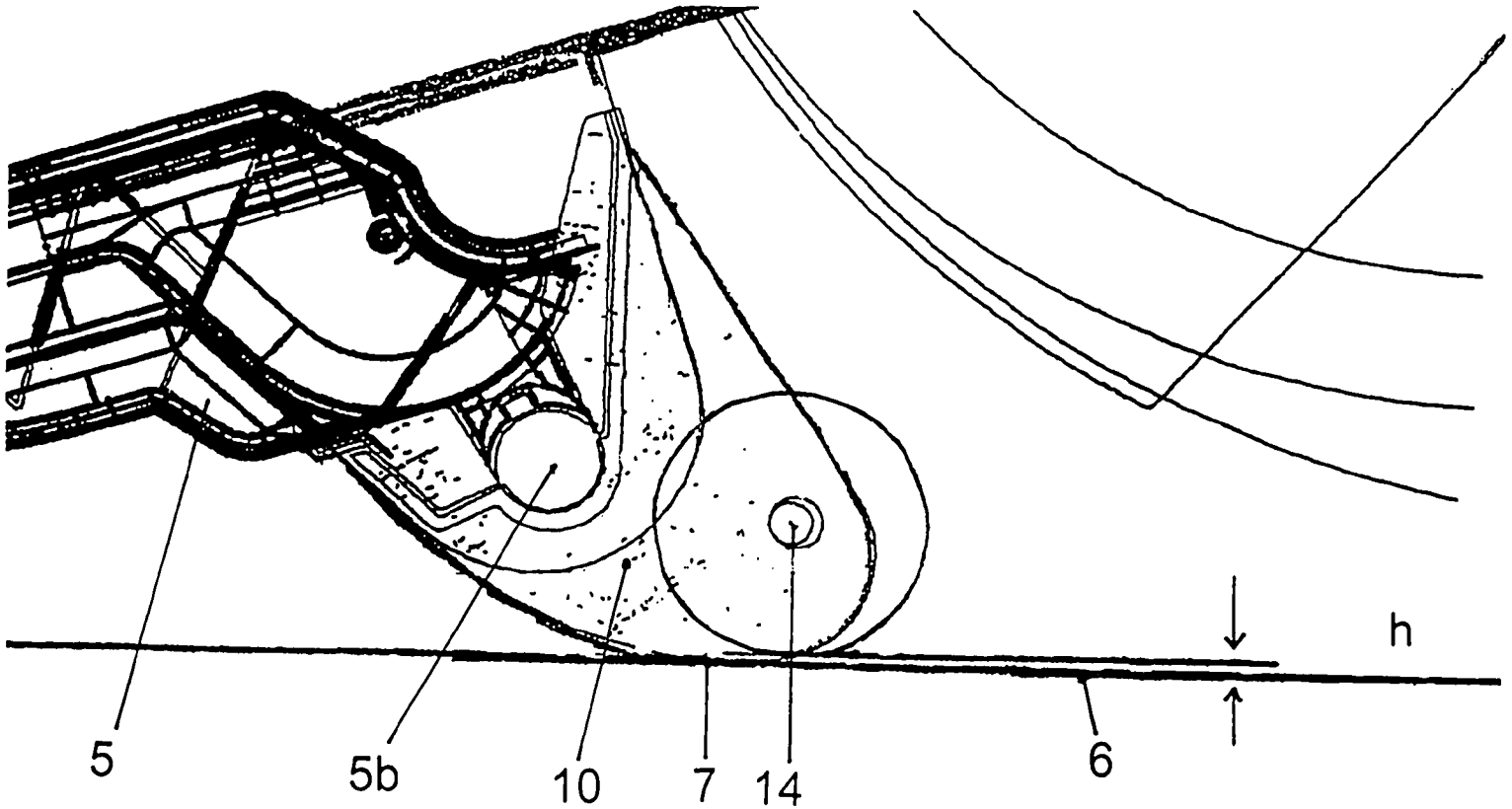
FIG. 2 shows a detailed view in FIG. 1.

FIG. 2 shows foot unit 10 in a detailed view. Foot unit 10 protectively covers the section of bracket grip 5*b* along the width of gripping unit 5. A front wall of foot unit 10, that is, one facing cutting disk 4*a*, 4*b*, 4*c*, is substantially straight and a rear wall, that is, facing the pistol grip, runs starting from gripping unit 5 to floor space 6 with an increasing bend and merges continuously into the front wall. The bent wall forms front support 7. In foot unit 10 mountings for the two wheels shafts 14 of wheels 12 are arranged above floor space 6 offset by the radius of the wheels plus height h toward gripping unit 5. Wheels 12 project toward cutting disk 4*a*, 4*b*, 4*c* over the front wall of foot unit 10.

Figure 3:
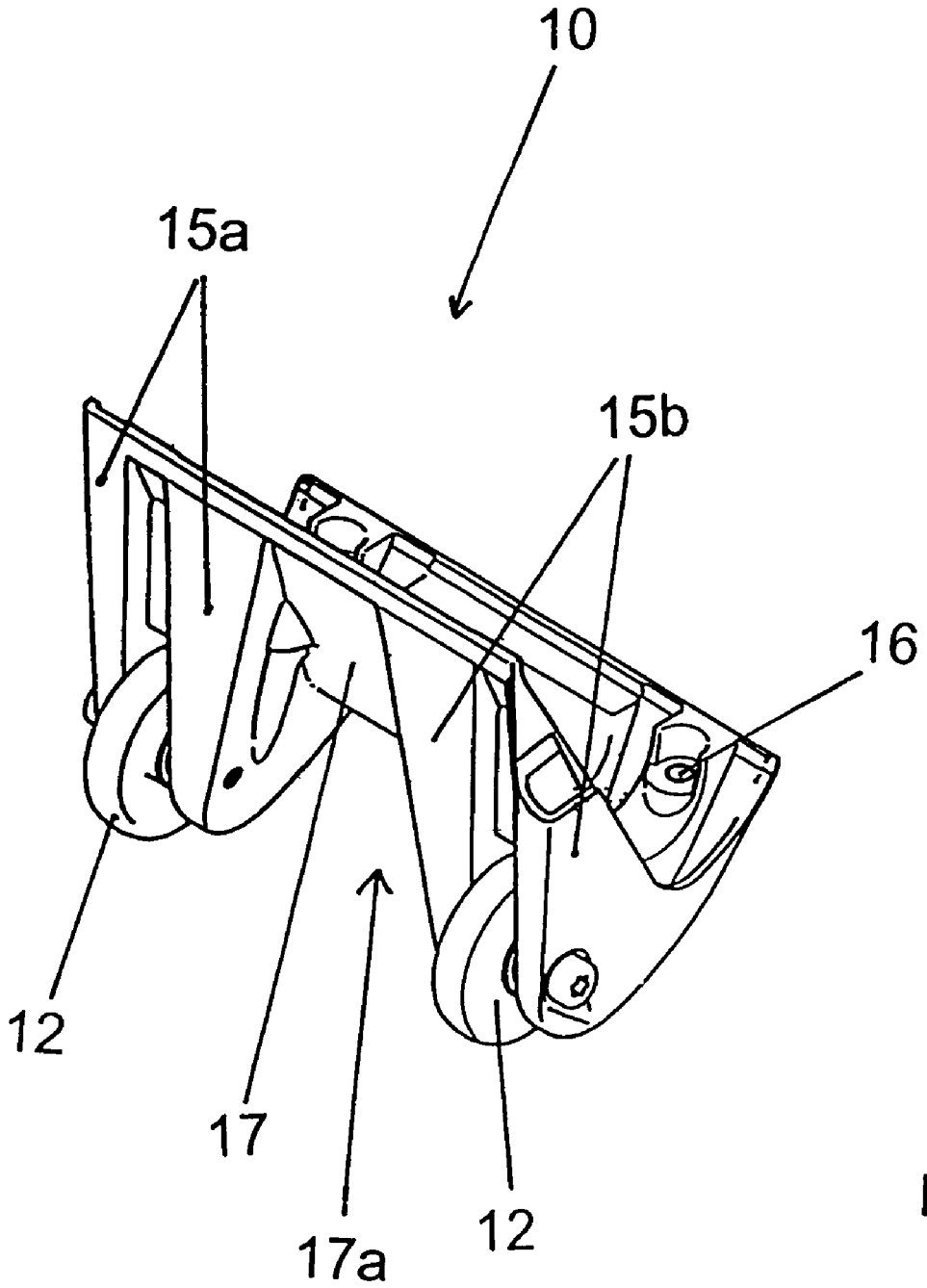
FIG. 3 shows a perspective view of the foot unit.

FIG. 3 shows a perspective view of foot unit 10. Foot unit 10 comprises two wheels 12, each with wheel shaft 14 and rotatably mounted in arm pair 15*a*, 15*b*. Foot unit 10 can be screwed to a light metal component by screws (not shown) that can be run through bores 16. Free space 17*a* for the removal of separated-out cut material is provided between the two arm pairs 15*a*, 15*b*. Foot unit 10 is protected by spark protection 17 in the area of free space 17*a*. Foot unit 10 consists of a one-part injection molded, plastic shaped part.

The invention claimed is:

1. A work device comprising at least one support on which the work device is supported in a turned-off position on a floor space, which work device can be shifted from the turned-off position into a work position by being tilted about the at least one support, a cutting disk, at least one rolling means arranged between the support and the cutting disk, which rolling means contacts the floor space in the work position, and a foot unit on which the at least one rolling means and the at least one support are positioned.

2. The work device of claim 1, which device is an abrasive cutting-off machine.

3. The work device according to claim 1, wherein the rolling means comprises a shaft, and wherein the foot unit comprises at least one arm for seating the shaft, which shaft has an interval from the support that corresponds to a radius of the rolling means plus a height h.

4. The work device according to claim 1, which further comprises a wear zone arranged on the support.

5. The work device according to claim 1, wherein the foot unit is detachable from the work device, and substitutable with a foot unit having a different height.

6. The work device according to claim 5, wherein the foot unit comprises a detachable fastener.

7. The work device according to claim 5, wherein the work device further comprises a gripping unit positioned on a side of the work device facing the floor, which gripping unit comprises at least one holder for the detachable fastening of the foot unit on an end facing the cutting disk.

8. The work device according to claim 1, wherein the foot unit comprises two spaced arm pairs, each of which receives a rolling means.

9. The work device according to claim 8, wherein the foot unit comprises two spaced arm pairs, each of which receives a rolling means, and wherein the foot unit runs on the wall of the work device facing the floor on the end of the gripping unit facing the cutting disk along a width of the gripping unit, and has a free space between the two arm pairs for the removal of cut material.

10. The work device according to claim 9, which further comprises a protection means positioned between the two arm pairs for the removal of cut material.

* * * * *